US005666638A

United States Patent [19]

Bergendahl

[11] Patent Number: 5,666,638

[45] **Date of Patent: *Sep. 9, 1997**

[54] PROCESS FOR PRODUCING SPONGE IRON BRIQUETTES FROM FINE ORE

[75] Inventor: Hans Georg Bergendahl, Bochum, Germany

[73] Assignee: Maschinenfabrik Koppern GmbH & Co. KG, Germany

[ * ] Notice: The term of this patent shall not extend beyond the expiration date of Pat. No. 5,630,202.

[21] Appl. No.: 446,705

[22] PCT Filed: Sep. 30, 1993

[86] PCT No.: PCT/EP93/02682

§ 371 Date: Aug. 7, 1995

§ 102(e) Date: Aug. 7, 1995

[87] PCT Pub. No.: WO95/09080

PCT Pub. Date: Apr. 6, 1995

[51] Int. Cl.[6] ..... B22F 1/00

[52] U.S. Cl. ..... 419/66; 75/751; 75/758

[58] Field of Search ..... 419/33, 31, 66, 419/69; 75/436, 751, 755, 758, 759; 425/579

[56] References Cited

U.S. PATENT DOCUMENTS 3,627,288 12/1971 MacDonald .
4,601,728 7/1986 Dungs et al. .

*Primary Examiner*—Charles T. Jordan
*Assistant Examiner*—Anthony R. Chi
*Attorney, Agent, or Firm*—Venable, Baetjer, Howard & Civiletti, LLP

[57] ABSTRACT

The present invention relates to a method for making sponge iron briquettes from fine ore with a maximum grain size of less than 2 mm, preferably less than 0.5 mm, wherein hot fine ore is fed to a roller press comprising two press rolls and is briquetted by opposite briquette pockets of the press rolls in the nip to form sponge iron briquettes. The direct pressing of fine ore into sponge iron briquettes has largely been unknown in the prior art. The invention proposes that one of the press rolls be operated as a loose roll which is substantially movable in a direction transverse to the roller axis, the nip adapting to the amount of material supplied to the press rolls and the nip substantially having such a mean width that a briquette strip is produced. In comparison with a former method, the method of the invention achieves a markedly increased service life of the molding bodies which are provided with press pockets.

19 Claims, 3 Drawing Sheets

PROCESS FOR PRODUCING SPONGE IRON BRIQUETTES FROM FINE ORE

DESCRIPTION

The present invention relates to a method for making sponge iron briquettes from fine ore with a maximum grain size of less than 2 mm, preferably less than 0.5 mm, wherein hot fine ore is fed to a roller press having two press rolls and is briquetted by opposite briquette pockets of the press rolls in the nip to form sponge iron briquettes.

A single installation is known in the prior art for producing sponge iron briquettes by directly pressing fine ore. To achieve a pleasant appearance of the briquettes of fine ore, the installation is operated with a fixed nip. The briquette seam is here made so thin that the briquettes are discharged from the roller press substantially in isolated form. Subsequently, the briquettes fall into a rotary screening drum where they are then separated from fine ore which was compacted by one of the separating webs between the briquette pockets in the briquetting process, and from fines in dust form. This method has never been very successful in the prior art, since problems have arisen from this method time and again.

It is therefore the object of the present invention to provide an improved method for making sponge iron briquetts from fine ore.

The object is attained according to the invention in that one of the press rolls is operated as a loose roll which is substantially movable in a direction transverse to the roller axis against a supporting force, with the nip adapting to the amount of material fed to the press rolls and the nip having substantially such a mean width that a briquette strip is formed.

Although it is already known in the briquetting of pellets and/or lump ore that the briquetting material is briquetted with a loose roll and a fixed roll and that the nip is adjusted such that a briquette strip is formed, it has always been assumed in the prior art that fine ore has to be pelletized prior to the briquetting process so that the pellets stretch in the area of the briquette seam during briquetting and contribute to bridging and to the achievement of a briquette strip at all.

The present invention shows however that it is certainly possible to press fine ore directly into a briquette strip, the invention having the enormous advantage as compared with the single briquetting method in which fine ore is not compacted, that there is a considerable increase in the service life of the molding bodies of the press rolls which consist of segments or rings provided with briquette pockets, which in the final analysis will lead to reduced lower segment or ring costs. Although the appearance of the briquettes is not quite so good any more, these are after all intermediate products that are intended for further processing, so that such a drawback is of very little importance in view of the improved service life.

Furthermore, it is of special advantage when during briquetting fine ore which is compacted by one of the separating webs between the briquette pockets, and fines in dust form are produced, said materials being separated as returns from the sponge iron briquettes and directly supplied to a conveyor system, and the still hot returns are supplied by the conveyor system substantially uniformly and continuously to the hot fine ore to be still briquetted. The fine ore is then coarsened evenly by the continuously fed returns, which is of advantage to an improved briquetting capacity. In particular, this step of the method is very positive at the beginning of the briquetting process, since no additional measure has to be taken for preventing the fine ore from simply flowing through the nip, which can certainly happen with excessively loosened fine ore.

In another advantageous step, the briquette strip can be divided by a briquette strip divider into individual sponge iron briquettes and returns. The sponge iron briquettes and the returns can subsequently be conveyed to a vibrating screen, which separates sponge iron briquettes and returns from each other.

The fine ore which is mostly loosened due to transportation from the reducing system to the press roll can be deoxidized in that the fine ore and returns are supplied to a screw hopper arranged above the briquetting rolls. Gas entrapped between the individual particles can then espace in this screw hopper. The screw of the screw hopper can press the mixed fine ore and returns into the nip of the briquetting rolls. The screw thus ensures a kind of precompaction, whereby the gas amount is once again reduced. Furthermore, a selective allocation of the amount of fine ore can be performed by the screw.

The width of the nip and the mean compacting pressure prevailing therein can be adjusted in an especially simple manner by substantially at least one hydraulic cylinder which is provided on the loose roll and applies the supporting force. In particular, the hydraulic pressure can then be measured in the hydraulic circuit of the hydraulic cylinder and used as a controlled variable for controlling the screw speed. The nip can be kept substantially constant due to this control concept, with the compacting pressure within the nip being then predominantly defined by the amount of material supplied by the screw. An over-load on the molding bodies of the compacting rolls can thus be prevented.

In another control concept it is suggested that the path of displacement of the loose roll be measured and used as a controlled variable for controlling the screw speed. Hence, as soon as the loose roll deflects because of an excessive compacting pressure, the screw speed is readjusted accordingly. The advantages of this control lie also in the observance of a substantially constant nip and an increased service life of the molding body.

Another control concept suggests that the torque or the power consumption of at least one press roll be measured and used as a controlled variable for controlling the screw speed. This control can be implemented in an especially simple manner with small constructional efforts.

Protection is now sought for a roller press for performing the method according to any one of claims 1 to 8.

The roller press is characterized by a pair of rolls which are provided with molding pockets and include a fixed roll and a loose roll which adapts to the amount of material supplied and is movable in a direction transverse to the roller axis against a supporting force. Such a roller press for directly pressing fine ore is not known in the prior art.

The loose roll is advantageously supported in movable bearing blocks. At least one hydraulic cylinder by which the bearing blocks can be moved for adjusting the width of the nip and the mean compacting pressure prevailing therein may be provided for shifting the bearing blocks. With the relatively large dimensions of the roller press, such a mechanism is a simple and nevertheless reliable constructional solution for providing a suitable supporting force.

As already mentioned above, a screw hopper whose prepress screw is substantially arranged at the lower end of the screw hopper and above the nip of the pair of rolls for pressing mixed fine ore and returns into the nip can be arranged above the pair of rolls for deoxidizing the fine ore.

A control circuit can be provided for adjusting the nip and the compacting pressure within the rolls, the control circuit having disposed therein a distance measuring means for measuring the path of displacement of the loose roll, with the measured data thereof being adapted to be supplied to a control means for controlling the screw speed and the control means setting the screw speed in consideration of the measured data.

Another controlling possibility is that a pressure measuring means is provided for measuring the hydraulic pressure in the hydraulic circuit of the hydraulic cylinder, the measured data thereof being adapted to be supplied to a control means for controlling the screw speed, and the control means setting the screw speed in consideration of the measured data. The two above-mentioned control concepts can be implemented in a very simple manner by commercially available components.

A control is also of advantage wherein a measuring means is provided for measuring the torque or power consumption of at least one of the press rolls, the measured data thereof being adapted to be supplied to a control means for controlling the screw speed, and the control means setting the screw speed in consideration of the measured data. This is a simple control since the briquette seam thickness is directly proportional to the power to be consumed.

It is of advantage on account of the poor feed of the fine ore when the roll diameter is substantially 1000 mm to 1800 mm, preferably 1400 mm. At the same degree of opening and at smaller roll diameters, a briquette pocket above the nip has a longer closing time along the compression path.

This is necessary for permitting a degasification of the pores in this state. To this end, it is especially advantageous when the cirumferential speed of the press rolls is substantially 0.4 m/s at the most.

In an advantageous embodiment the briquette strip divider has a rotor which in its outer circumference has radially projecting rotor blades for dividing the briquette strip. Correspondingly large striking forces for severing the briquette can be provided on the outer circumference in such an embodiment.

An embodiment of the present invention will now be described in more detail with reference to a drawing, in which:

Figure 1:
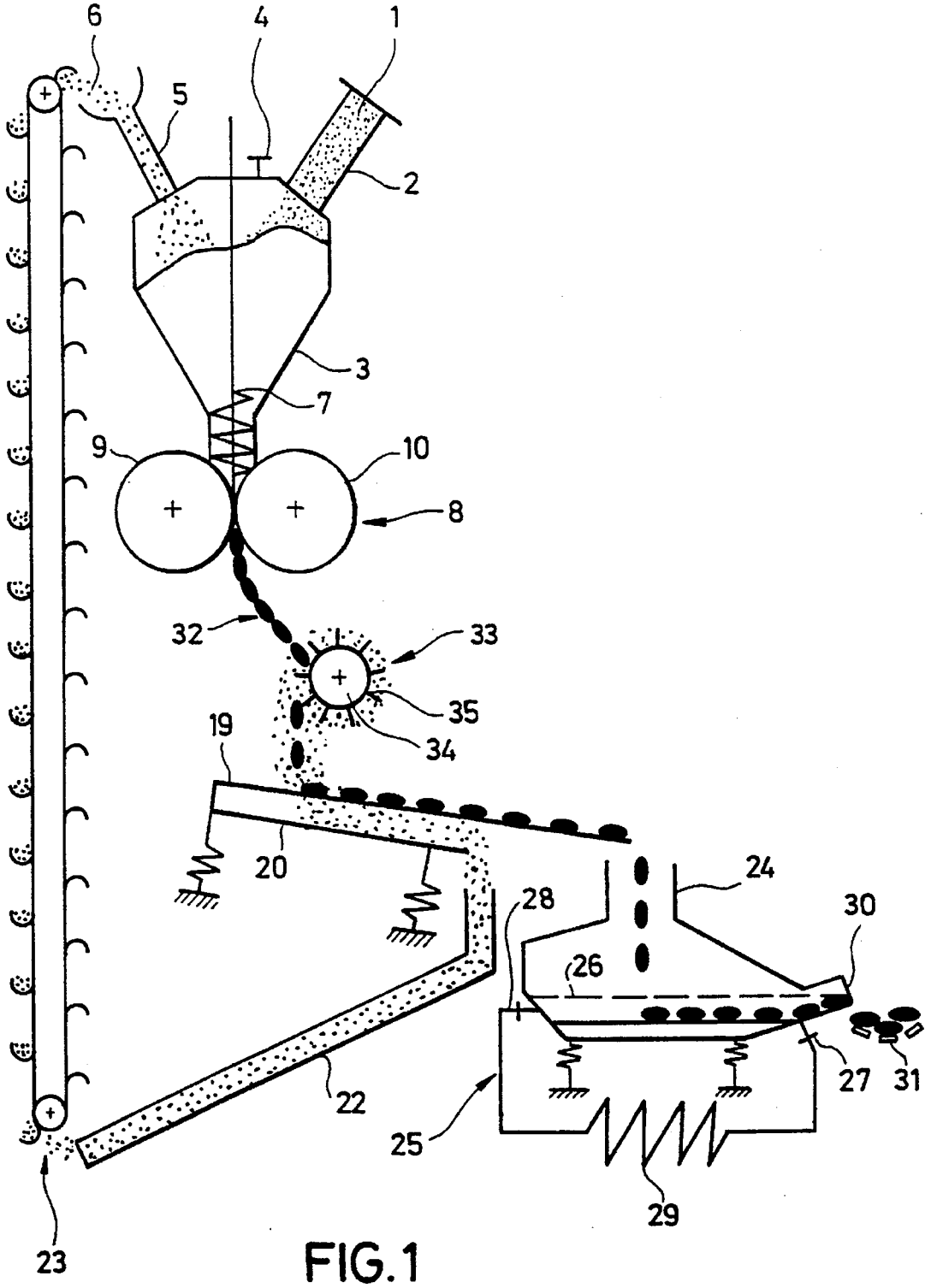
FIG. 1 is a diagrammatic view of a hot-briquetting installation for performing the method of the invention.

A first embodiment of the method of the invention and an embodiment of an apparatus for performing said method will now be explained in the following text, in particular, with reference to FIG. 1. A particulate sponge iron which has been processed in a fluidized bed and is supplied in reduced form and in a hot state to the hot-briquetting installation serves as the starting product for the present method. The grain size of the fine ore 1 is here 2 mm at the most, most of the fine ore having, however, a size of less than 0.5 mm. The temperature of the fine ore 1 is substantially between 650° C. and 830° C. The fine ore 1 has a bulk weight of about 2.3 g/cm$^3$ and is fed to the hot-briquetting installation via a supply nozzle 2 which is arranged on an upper end portion of a screw hopper 3. The fine ore 1 is loosened due to transportation to a very great extent, so that a fluidization may even take place. As a consequence, screw hopper 3 is not fully filled with bulk material, so that gas inclusions in the fine ore 1 can escape upwards and can be discharged via a ventilating valve 4.

Furthermore, a downpipe 5 is provided on the upper end portion of the screw hopper 3 for supplying returns 6 into the screw hopper 3. The returns 6 are composed of compacted fine ore having a grain size of less than 2 mm, preferably less than 0.5 mm.

Furthermore, the screw hopper 3 has arranged therein a prepress screw 7 which presses mixed returns 6 and fine ore 1 into the nip of a roller press 8. The screw shaft is driven via a hydraulic drive (not shown) which has a torque that is high in case of a clamping of screw 7 and is capable of flexibly adapting to all kinds of variations. The screw hopper 3 is made of a highly refractory steel and is surrounded with an insulation (not shown) for protection against heat radiation. The roller press 8 has a first press roll 9 and a second press roll 10.

Figure 2:
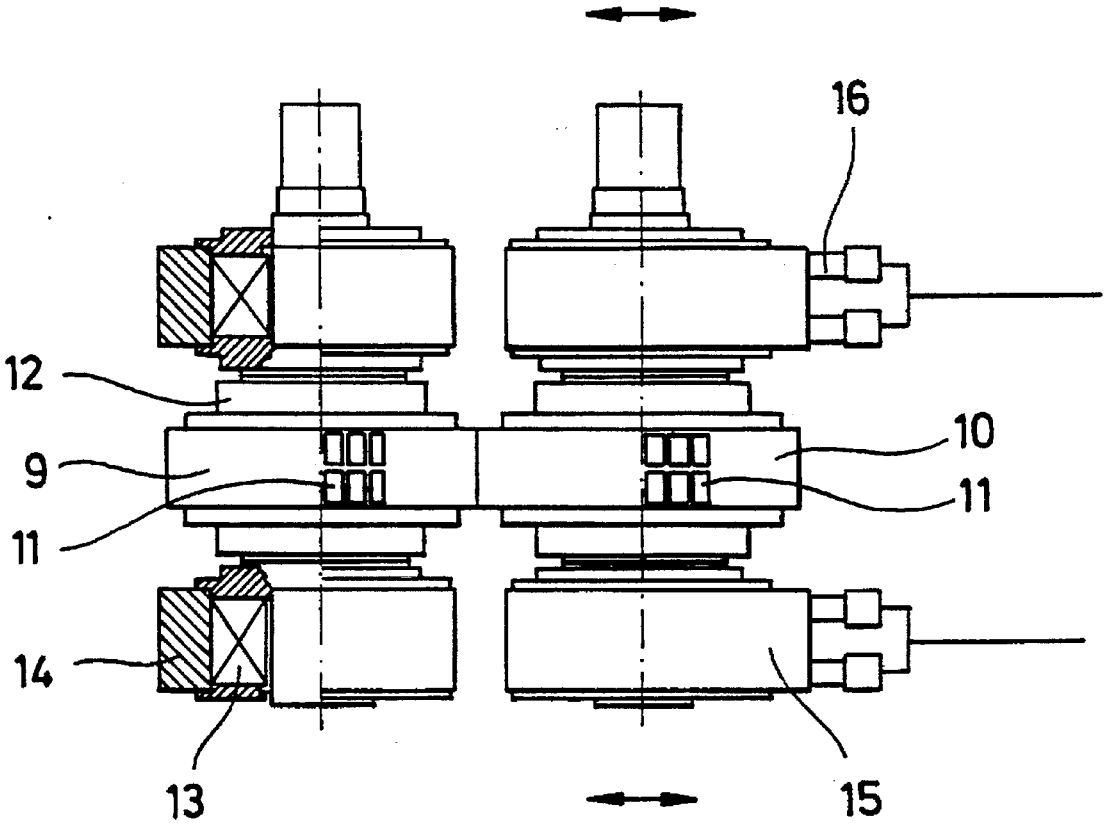
FIG. 2 is a diagrammatic top view on a briquette roller press according to the present invention.

As can especially be seen in FIG. 2, the rolls are equipped with molding tools of segments or rings provided with briquette pockets 11. A roller body 12 on which the molding tools are mounted is supported in preferably self-aligning roller bearings 13 and provided with a corresponding cooling means (not shown). The press roll 9 is designed in this embodiment as a fixed roll, so that the bearing housing 14 is immovably arranged. By contrast, the second press roll 10 has a movable bearing housing 15, whereby the nip between the first and second press rolls 9 and 10 can be adjusted. The necessary displacement path and the necessary contact pressure of the two press rolls 9 and 10 are obtained through hydraulic cylinders 16 which act on the displaceable bearing housing 15.

To this end, the hydraulic pressure in the hydraulic cylinders 16 is chosen such that these are displaced accordingly at an increased pressure in the nip of press rolls 9 and 10. As a result, the loose roll 10 can adapt to the amount of material which is pressed by screw 7 into the nip. This process can clearly be recognized through the movement of the bearing housing 15 during operation of the roller press 8. The displacement 0f the bearing housing 15 serves as an indication of the size of the nip and thus of the seam thickness between the individual briquettes 17. In accordance with the movement of roll 10, the hydraulic pressure in the hydraulic circuit of the hydraulic cylinder 16 also changes. The path of displacement of the bearing housing 15 can be sensed with the aid of a distance measuring means. The measured data are then supplied to a control means which uses the measured data for controlling the screw speed. This results in a control circuit which leads to the production of a desired briquette strip with a corresponding briquette seam thickness. Another or additional possibility of control is that the hydraulic pressure in the hydraulic circuit of the hydraulic cylinder 16 is measured with a pressure measuring device and the measured data are supplied as a controlled variable to a controlling system for controlling the screw speed.

In another or additional control the torque or power consumption of at least one press roll 9, 10 is measured by a measuring means. Since briquette seams of increased thickness have to be pressed with more power, the torque or power consumption on press rolls 9, 10 increases. The screw speed can then be readjusted by a control means. In case of a combination with other control concepts, limits of the pressure or nip can, for instance, be monitored.

Undesired factors, such as different temperatures, bulk densities and grain sizes of the briquetting material can be compensated very easily with the aid of such control concepts. The diameter of the press rolls 9 and 10 is normally between 1000 mm and 1800 mm, preferably 1400 mm. This leads to a long closing path of the briquette pockets 11, which results in an improved degasification of the fine ore 1. To this end, the circumferential roll speed is substantially 0.4 m/s at the most.

The purposeful coarsening of the briquetting material promotes the formation of a briquette strip 32 with fine ore 1 as the starting product. The individual briquettes 17 adhere now to each other at the briquette seams due to the relatively big nip.

Figure 3:
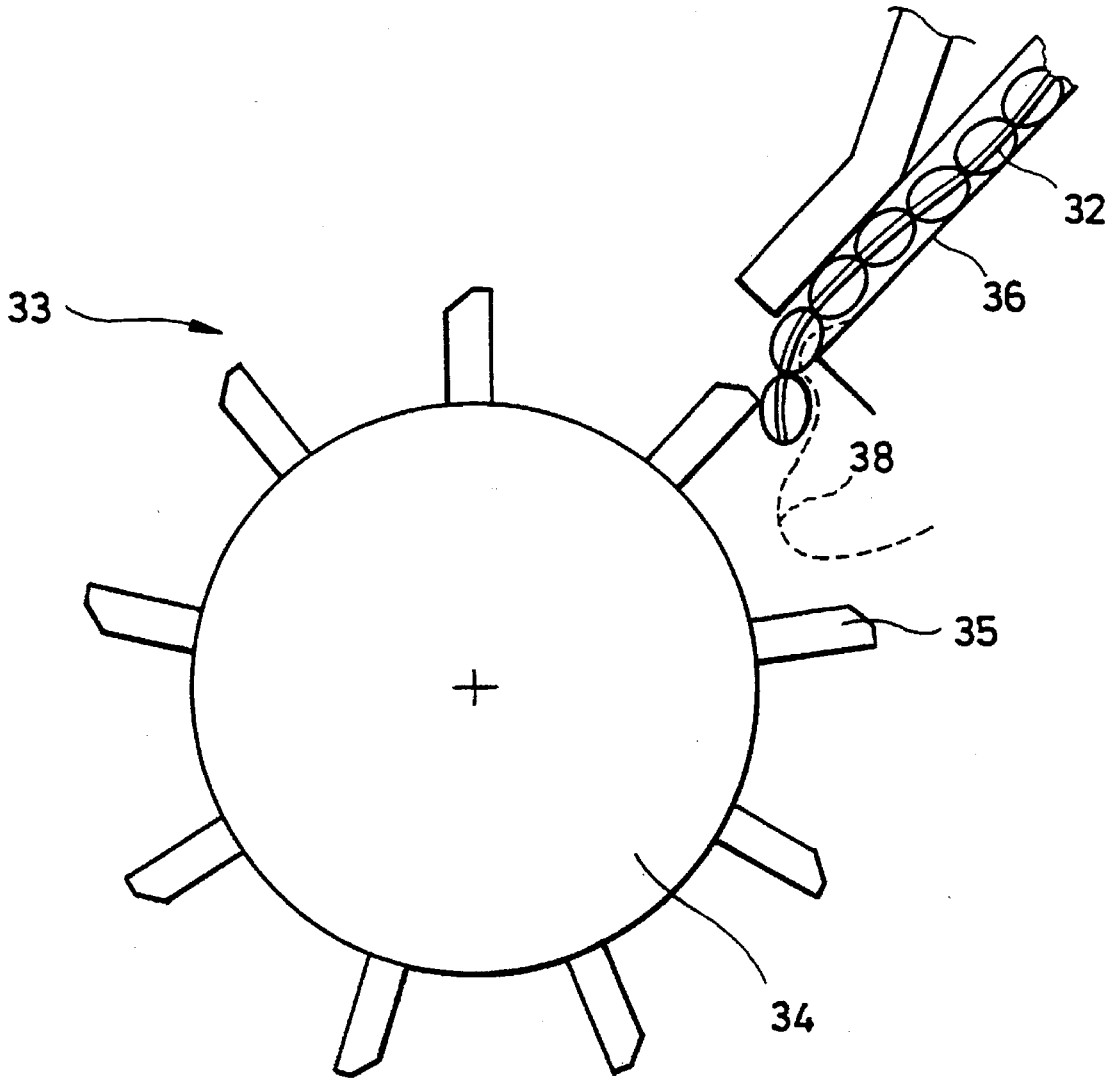
FIG. 3 is a diagrammatic view of a briquette strip divider.

The briquette strip must subsequently be divided again by a separating device into individual briquettes 17 and returns 6. The separating device has associated therewith a briquette strip divider 33 which, as can especially be seen in FIG. 3, includes a rotor which has radially projecting rotor blades 35 on its outer circumference. The circumferential speed of rotor 34 is adapted to the speed of the roller press 8, so that a briquette is respectively knocked off with a rotor blade 35. To this end, the briquette strip 32 is guided on a guide rail 36 above the free end of which a holding-down device 37 is provided for holding down the briquette strip 32 which vaults during the knocking-off operation. Since, as can be gathered from FIG. 2, the briquette strip 32 is also formed of two respectively adjacent briquettes 17, there is additionally provided a nose 38, which is drawn in broken line in FIG. 3. Nose 38 severs the center web of the briquette strip 32. To this end, rotor 34 is preferably formed accordingly.

The briquettes 17 are isolated by the striking process of the rotor 34, resulting in the formation of corresponding returns 6.

Underneath the briquette strip divider 33, returns 6 and briquettes 17 fall onto a vibrating screen 19 which is preferably provided with a mesh width of 8 mm to 15 mm. All of the return pieces below a specific size fall through the screen 19 due to the shaking motion of the vibrating screen 19, which is also slightly inclined, and are passed onto a vibrating surface 20 which is arranged below the screen 19 substantially in parallel therewith. When the vibrating screen 19 is chosen such that it has a sufficient length, all of the returns below a specific size will be separated from the briquettes 17 after having covered a certain distance. The vibrating surface 20 has a discharge end 21 which has provided underneath a downwardly extending returns chute 22. The returns chute 22 receives returns 6 and passes them onwards to a lower portion of a continuous conveyor 23 which immediately receives the returns 6 and conveys them upwards. The continuous conveyor 23 is preferably formed as a bucket elevator. At its upper end, the continuous conveyor 23 discharges the returns 6 to the conveyor pipe 5, so that the returns pass into the screw hopper 3. Depending on the duration of the operation of the return system, the temperature loss of the returns 6 will be relatively small. The whole return period in screen 19 to screw 7 is approximately only 30 seconds. This means that the existing temperature of the returns 6 is still at least 300° C. when these are filled into the screw hopper.

All of the compacted parts above the mesh size of the vibrating screen 19 will now be further transported by the slightly inclined vibrating screen 19 until they are filled into a briquette chute 24. The briquette chute 23 ends in a briquette cooler 25 which is designed as a vibration cooler which cools with a water bath. Water bath 26 ensures a rapid cooling of briquettes 17 and simultaneously prevents the reoxidation thereof in the hot state. A water inlet 27 is arranged on the briquette cooler 25 for supplying fresh water for the water bath 26 and a water outlet 28 is arranged for discharging water from the heated water bath 26. The cooling water is transported in a cooling circuit from the water outlet 28 via a heat exchanger 29 to the water inlet 27 and is passed within the briquette cooler 25 in counterflow fashion relative to the direction of transportation of the briquettes 17 through cooler 25. Briquettes 17 are cooled from about 700° C. to about 80° C. The discharge temperature of the briquettes 17 can be varied by controlling the water circulation amount and retention time of briquettes 17 in water bath 26. When the briquettes 17 are discharged at about 80° C. at a discharge point 30 of the briquette cooler 25, the residual heat of briquettes 17 is sufficient for drying the surface of briquettes 17. The briquette cooler 25 is preferably equipped with a controllable drive which permits the adjustment of the retention time of briquettes 17. Briquettes 17 then pass from the discharge point 30 to a briquette conveyor belt 31.

Sponge iron has a great tendency to reoxidation, especially in cases where the temperature thereof is still relatively high. During briquetting a certain amount of fines passes in unpressed form through roller press 8. As a consequence, all spaces around the roller press 8, the separating device, as well as the space around the continuous conveyor 23 must be kept in a low-oxygen state by all means. To this end, flushing with inert gas is preferably performed, or an inert gas atmosphere is established. The individual units are equipped with corresponding connections for inert gas. The screw hopper 3 and the briquette cooler 25 may each have a connection for inert gas. To this end, the units have substantially gastight housings (not shown). The temperature loss of the returns 6 can be reduced once more by providing a hot atmosphere of inert gas.

The relatively fine starting material is especially taken into account in the roll diameters and in the circumferential speed at which press rolls 9 and 10 can make briquettes. A roll diameter of about 1000 mm to 1800 mm, preferably about 1400 mm, has turned out to be advantageous because of the poor feed of the fine ore 1. The circumferential speed is 0.4 m/s at the most, which corresponds to a speed of about 5 revolutions per minute. If fine ore 1 is to be processed with an especially small grain size, this makes it necessary to reduce the roll speed considerably. That is why in such systems the speed is controlled not only in accordance with the desired amount of discharge, but also in accordance with the briquetting capacity of the fine ore 1. This means that the finer the starting product is, the slower the rotation of the press rolls 9 and 10 has to be. This, however, means also that at an optimum grain size an increase in the throughput of the roller press 8 can be expected when the circumferential speeds are increased. Such an optimum grain size, however, can also be achieved by mixing a corresponding amount of returns 6 to the fine ore 1 which is per se too fine. It becomes apparent how great the influence can be that is exerted by the continuous returning of the returns 6 on the briquetting capacity of the fine ore 1. Furthermore, there are no local over-loads on the press rolls 9 during processing, since the particle size of the returns 6 does not exceed a specific value and the temperature of the returns 6 is still so high that a considerable decrease in the temperature of the mixed briquetting material does not take place.

Hence, the method of the invention still provides the possibility of processing fine ore independently of the control concept of the roller press 8. The briquetting of fine ore according to the present invention has, in particular, the advantage that the service life of the molding tools with the briquette pockets 11 can be considerably increased. As a result, the segment or ring costs in hot-briquetting installations for fine ore can be considerably reduced.

I claim:

1. A method for making sponge iron briquettes (17) from fine ore (1) with a maximum grain size of less than 2 mm, preferably less than 0.5 mm, wherein hot fine ore (1) is fed to a roller press (8) comprising two press rolls (9, 10) and is briquetted by opposite briquette pockets (11) of said press rolls (8) in a nip to form sponge iron briquettes (17), characterized in that one of said press rolls (10) is operated as a loose roll which is substantially movable in a direction transverse to the roller axis against a supporting force, said nip adapting to the amount of material supplied to said press rolls (9, 10) and said nip having substantially such a mean width that a briquette strip (32) is produced.

2. A method according to claim 1, characterized in that during briquetting fine ore (1) compacted between said briquette pockets (11) by one of the separating webs, and fines in the form of dust are produced, said materials being separated as returns (6) from said sponge iron briquettes (17) and directly supplied to a conveyor system (23), and said returns (6) which are still in their hot state are fed by said conveyor system, (23) substantially evenly and continuously to the hot fine ore (1) to be still briquetted.

3. A method according to claim 1 or, characterized in that said briquette strip (32) is divided by a briquette strip divider (33) into individual sponge iron briquettes (17) and returns (6).

4. A method according to claim 1, characterized in that after the dividing process said sponge iron briquettes (17) and said returns (6) are conveyed to a vibrating screen (19) which separates sponge iron briquettes (17) and returns (6) from one another.

5. A method according to claim 1, characterized in that fine ore (1) and returns (6) are supplied to a screw hopper (3) arranged above said briquetting rolls (9, 10), whose screw (7) presses the mixed fine ore (1) and returns (6) into the nip of said briquetting rolls (9, 10).

6. A method according claim 1, characterized in that the width of said nip and the mean compacting pressure prevailing therein are substantially set by at least one hydraulic cylinder (16) mounted on said loose roll (10).

7. A method according to claim 1, characterized in that said hydraulic pressure in said hydraulic circuit of said hydraulic cylinder (16) is measured and used as a controlled variable for controlling the screw speed.

8. A method according to claim 1, characterized in that the displacement path of said loose roll (10) is measured and used as a controlled variable for controlling the screw speed.

9. A method according claim 1, characterized in that the torque or power consumption of at least one press roll (9, 10) is measured and used as a controlled variable for controlling the screw speed.

10. A roller press for performing the method according to claim 1, characterized by a pair of rolls (9, 10) provided with molding pockets (12) and including a fixed roll (9) and a loose roll (10) which adapts to the supplied amount of material and is movable in a direction transverse to said roller axis against a supporting force.

11. A roller press according to claim 10, characterized in that said loose roll (10) is supported in movable bearing blocks (15).

12. A roller press according to claim 10, characterized in that there is provided at least one hydraulic cylinder (16) through which said bearing blocks (15) can be moved for adjusting the width of said nip and the mean compacting pressure prevailing therein.

13. A roller press according to claim 10, characterized in that said pair of rolls (9, 10) has arranged thereabove a screw hopper (3) whose prepress screw (7) is substantially arranged at the lower end of said screw hopper (3) and above said nip of said pair of rolls (9, 10) for pressing mixed fine ore (1) and returns (6) into said nip.

14. A roller press according to claim 10, characterized in that a distance measuring means is provided for measuring the path of displacement of said loose roll (10), the measured data thereof being adapted to be supplied to a control means for controlling the screw speed, said control means adjusting said screw speed in consideration of said measured data.

15. A roller press according to claim 10, characterized in that a pressure measuring means is provided for measuring the hydraulic pressure in said hydraulic cylinder (15), the measured data thereof being adapted to be supplied to a control means for controlling the screw speed, and said control means adjusting the screw speed in consideration of said measured data.

16. A roller press according to claim 10, characterized in that a measuring means is provided for measuring the torque or power consumption of at least one of said press rolls (9, 10), the measured data thereof being adapted to be supplied to a control means for controlling the screw speed, and said control means adjusting said screw speed in consideration of said measured data.

17. A roller press according to claim 10, characterized in that said roller diameter is substantially 1000 mm to 1800 mm, preferably 1400 mm.

18. A roller press according to claim 10, characterized in that the circumferential speed of said press rolls (9, 10) is substantially 0.4 m/s at the most.

19. A roller press according to claim 10, characterized in that said briquette strip divider (33) comprises a rotor (34) which has radially projecting rotor blades (35) on its outer circumference for dividing said briquette strip (32).

* * * * *